United States Patent [19]

Burroughs

[11] Patent Number: 4,815,538

[45] Date of Patent: Mar. 28, 1989

[54] WASH TOOL FOR WELL HAVING PERFORATED CASING

[75] Inventor: Thomas C. Burroughs, Houston, Tex.

[73] Assignee: The Cavins Corporation, Houston, Tex.

[21] Appl. No.: 207,246

[22] Filed: Jun. 16, 1988

[51] Int. Cl.[4] ..... E21B 33/127

[52] U.S. Cl. ..... 166/312; 166/186; 166/187; 166/191

[58] Field of Search ..... 166/185, 186, 187, 188, 166/191, 312

[56] References Cited

U.S. PATENT DOCUMENTS

| | | | |
|---|---|---|---|
| Re. 31,842 | 3/1985 | Weitz | 166/312 |
| 2,602,516 | 7/1952 | Gray | 175/88 |
| 2,764,244 | 9/1956 | Page | 166/187 |
| 3,059,699 | 10/1962 | Brown | 166/187 |
| 3,280,916 | 10/1966 | Barrington | 166/187 |
| 3,430,701 | 3/1969 | Canada | 166/186 |
| 3,456,725 | 7/1969 | Hatch | 166/147 |
| 4,030,545 | 6/1977 | Nebolsine | 166/191 |
| 4,279,306 | 7/1981 | Weitz | 166/312 |
| 4,311,314 | 1/1982 | Suman | 166/187 |
| 4,484,625 | 11/1984 | Barbee | 166/185 |
| 4,498,536 | 2/1985 | Ross et al. | 166/312 |

*Primary Examiner*—Stephen J. Novosad
*Assistant Examiner*—Terry Lee Melins
*Attorney, Agent, or Firm*—Dodge, Bush & Moseley

[57] ABSTRACT

A washing tool (24) attached to the lower end of a pipe string (18) includes a mandrel (28) between upper and lower subs (30, 32). The mandrel (28) has opposed spaced end sections (54 56) connected with an intermediate section (58). Each end section (54, 56) has a fluid inflatable elastomeric packer (64) thereon inflatable at a relatively low fluid pressure, and intermediate section (58) has a leaf spring (86) over a port (84) which is opened by outward movement of the leaf spring (86) at a second higher predetermined fluid pressure within the pipe string (18).

14 Claims, 2 Drawing Sheets

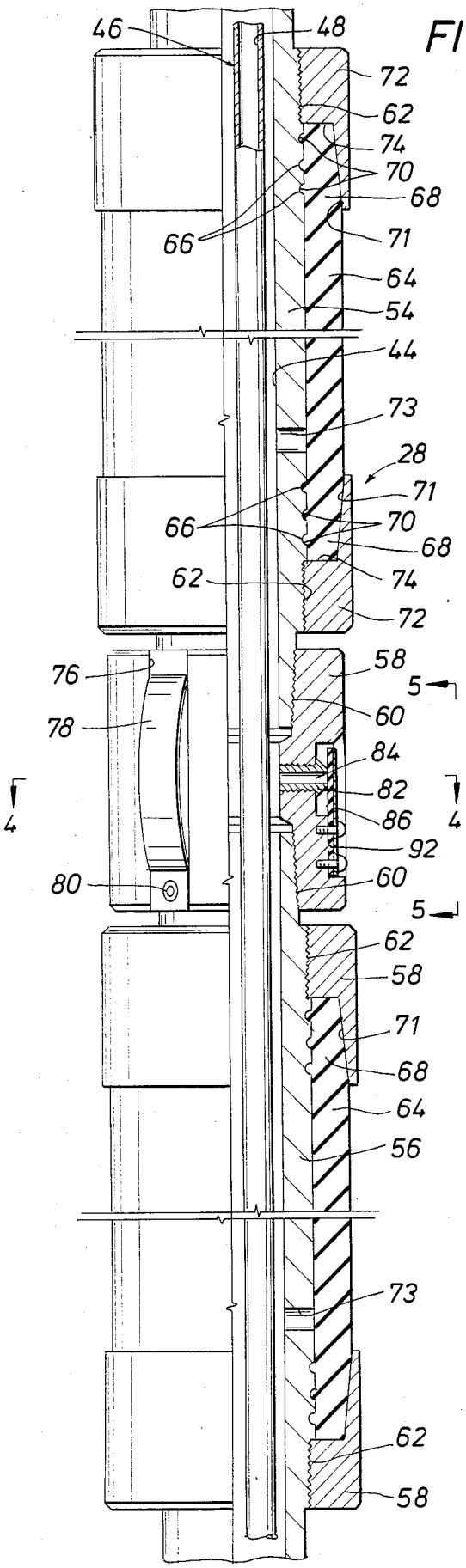
FIG. 3
FIG. 4
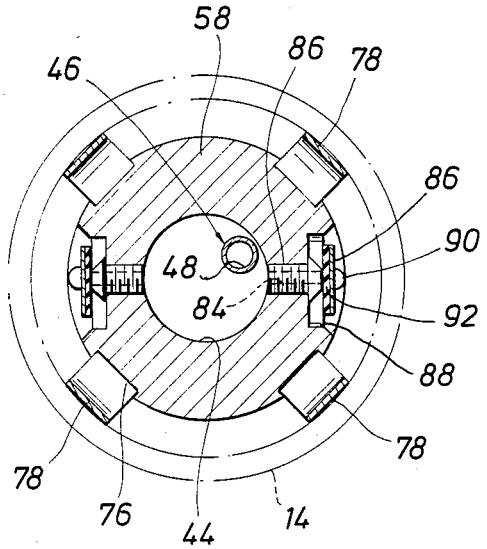
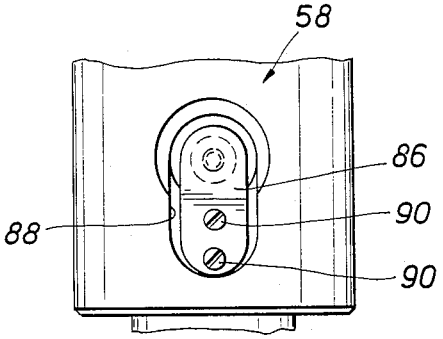
FIG. 5
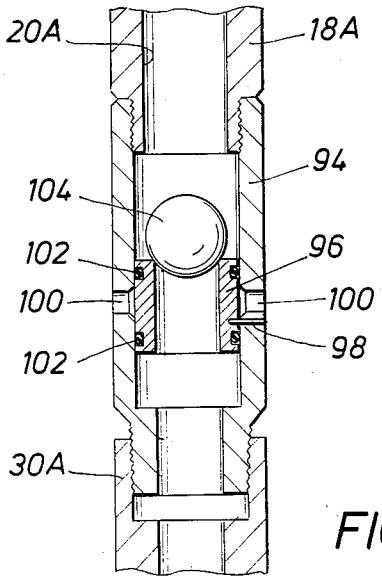
FIG. 6

WASH TOOL FOR WELL HAVING PERFORATED CASING

BACKGROUND OF THE INVENTION

This invention relates to an apparatus and method for washing the perforated zone of a well casing in an oil or gas well. More particularly, the invention is directed to a wash tool inserted within a perforated casing at a desired depth and the method of injecting a washing fluid through the tool into the zone adjacent the perforated casing.

Heretofore, such as shown in U.S. Pat. No. RE. 31,842, dated Mar. 5, 1985, well washing tools have been provided for insertion within perforated casing for injecting washing fluid through the tool into the zone adjacent the perforated casing. Such a well washing tool or so-called straddle packer is lowered to a desired depth in the well and fluid pressure is applied through the pipe string for expanding upper and lower packers into sealing engagement with the casing at a first predetermined pressure level while valve means block fluid flow into the formation or strata located between the packers. Then, upon an increase in the fluid pressure from the pipe string to a predetermined higher fluid pressure, valve means are actuated by such higher fluid pressure to permit fluid flow into the adjacent formation through the perforated casing between the packers. Upon a relief of fluid pressure within the pipe string, the valve means are again actuated to block fluid flow into the adjacent formation.

The well washing tool as shown in U.S. Pat. No. RE. 31,842 is relatively complicated for effecting the so-called two-stage operation in which the packers are first moved into sealing engagement with the perforated casing at a first predetermined fluid pressure while fluid to the formation is blocked by suitable valve means, and then at a second higher predetermined fluid pressure the valve means is actuated to permit fluid flow to the formation through the perforated casing. An annular chamber formed between the mandrel and an outer tubular member about the mandrel receives a pair of end pistons which are urged against the packers at the first fluid pressure level and a third intermediate piston which is urged at a second higher predetermined fluid pressure to a position unblocking ports to permit fluid flow to the formation.

Such an arrangement utilizing pistons with associated seals is relatively costly and complex for a wash tool. Also, relatively high fluid pressures, such as around one thousand (1,000) psi or greater, are required in order to urge the solid elastomeric packers radially outward into sealing engagement with the casing by compression of the packers in addition to being limited to a relatively small annular spacing as a result of such radial compression.

SUMMARY OF THE INVENTION

The present invention is directed to a washing tool for insertion within a perforated casing at a desired depth and the method of injecting a washing fluid into the adjacent formation. The wash tool includes a pair of spaced fluid inflatable elastomeric tubular packers, each secured at its lower and upper ends directly to the mandrel in face to face contact with the outer peripheral surface of the mandrel. Continuously open fluid ports through the mandrel wall adjacent the lower end of each fluid inflatable elastomeric packer permits fluid flow from the pipe string between the mandrel and the inner peripheral surface of the packers for urging the packers radially outwardly into sealing engagement with the adjacent perforated casing at a first predetermined fluid pressure and without any axial movement of the fluid inflatable packers relative to the mandrel.

Intermediate ports are provided through the mandrel wall between the upper and lower packers which ports are blocked or covered by a leaf spring while the packers are initially urged outwardly into sealing engagement with the casing at the first predetermined fluid pressure. At a second higher predetermined pressure from the pipe string, the resilient leaf spring is urged outwardly to uncover the port and permit fluid flow through the perforated casing into the adjacent formation. The fluid which is injected within the formation may include suitable chemicals or acid materials as desired and the present invention insures that a tight sealing relation is first achieved by the inflatable packers before fluid is injected within the formation.

Upon a reduction of fluid pressure below the second predetermined fluid pressure, the leaf spring returns to its initial position blocking its associated port. Further reduction in fluid pressure below the first predetermined pressure permits radial contraction of the elastomeric packers against the outer peripheral surface of the mandrel with the fluid in the fluid chambers between the mandrel and the inflatable packers being drained or discharged through the port or fluid passage means adjacent the lower end of each packer thereby to easily permit any foreign matter or debris such as sand in the fluid to be removed from the inflatable chamber between the mandrel and packer.

A fluid bypass mounted within the mandrel bore adjacent the packers has end ports beyond the packers to permit fluid in the annulus to bypass the packers and thereby equalize fluid pressure at opposite ends of the packers.

It is an object of this invention to provide a well washing tool and method of injecting fluid into a formation which is actuated at a low fluid pressure of around two hundred (200) psi.

A further object is to provide such a well washing tool having fluid inflatable elastomeric packers of a relatively small length which may be urged into sealing relation in a minimum of time with minimum fluid pressure.

An additional object of this invention is to provide a well washing tool for washing the perforated zone of a well casing and having upper and lower fluid inflatable elastomeric packers which are actuated at a first predetermined fluid pressure while fluid flow to the perforated casing is blocked, and a separate independent fluid control means between the packers actuated at a second higher predetermined fluid pressure to permit fluid flow through the perforated casing into the adjacent formation after sealing of the inflatable packers against the casing.

It is a further object to provide such a well washing tool that is simple in manufacture and operation, and utilizes a pair of opposed end sections connected by a disconnectable intermediate section with an inflatable elastomeric packer mounted on each end section and separate independent fluid control means mounted on the intermediate section.

An additional object is to provide for such a well washing tool a fluid bypass within the mandrel bore around the packers for equalizing fluid pressure in the annulus on opposed sides of the packers.

Other objects, features, and advantages of this invention become more apparent after referring to the following specifications and drawings.

BRIEF DESCRIPTION OF DRAWINGS

FIG. 3 is an enlarged fragment of the tool shown in FIG. 1 removed from the well;

FIG. 4 is a section taken generally along line 4—4 of FIG. 3 and showing particularly the arrangement of the valve means and centralizer on the intermediate section of the associated mandrel;

FIG. 5 is an elevation of the valve means shown in FIG. 4 looking generally along line 5—5 of FIG. 3 and including a resilient leaf spring member covering the associated port; and FIG. 6 is an enlarged section of a modified sub which may be utilized for blocking fluid flow from the pipe string after completion of the work operation.

BRIEF DESCRIPTION OF THE INVENTION

Figure 1:
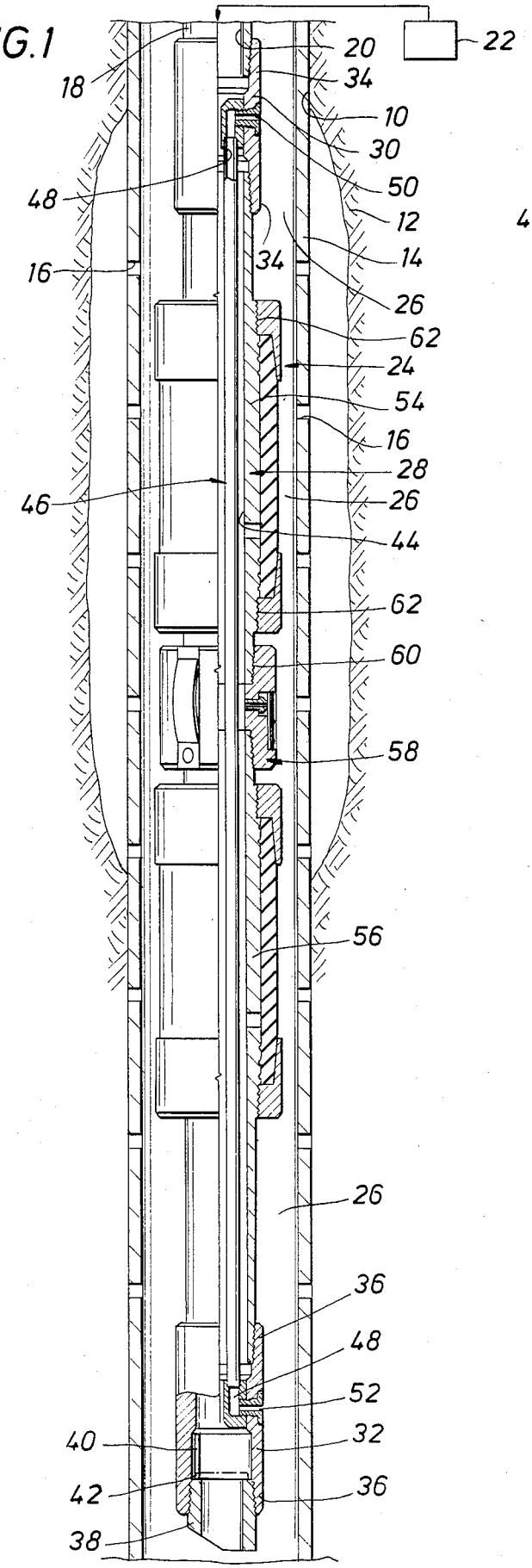
FIG. 1 is a sectional elevation of an oil well containing a perforated casing showing a tool of the present invention partially in section with the tool shown in the unset or running position.
Figure 2:
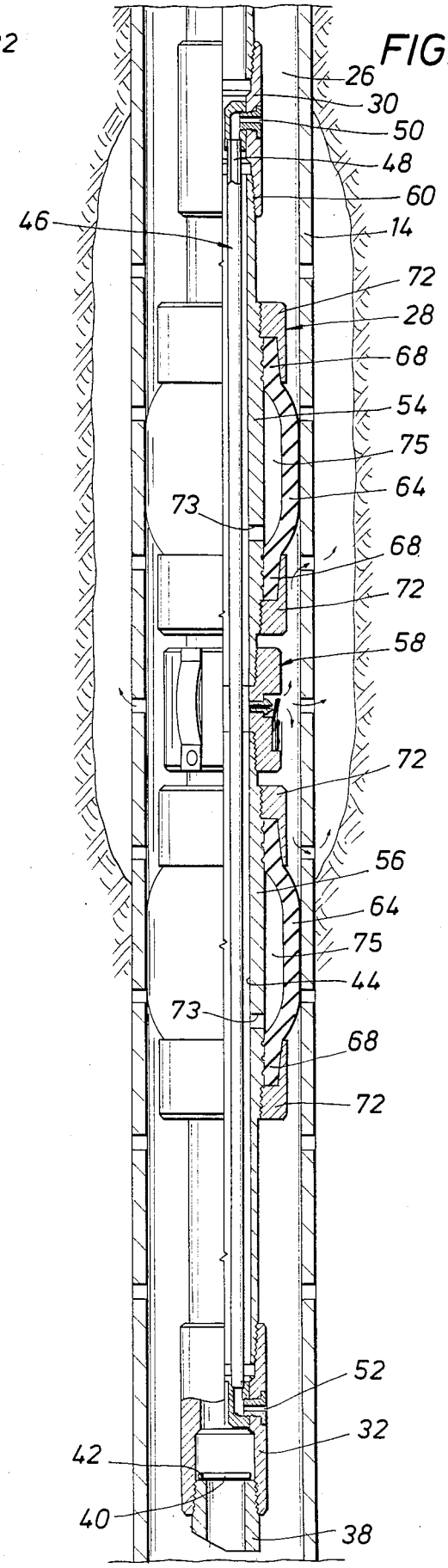
FIG. 2 is a sectional elevation similar to FIG. 1 but showing the tool in its set position with fluid being injected through the tool and through the perforated casing into the formation.

Referring now to the drawings for a better understanding of this invention, and more particularly to FIGS. 1 and 2, a well is indicated schematically having a bore hole 10 with a surrounding earth formation or strata 12. A perforated casing shown at 14 has perforations 16 therein and is positioned within the bore hole at a predetermined perforation zone or depth at which it is desirable to improve the flow characteristics. The lower end of a pipe string is shown generally at 18 and has an axial bore 20 which may receive drilling fluid therein from a suitable pump shown schematically at 22 which is normally provided at the surface or ground location.

A washing tool which forms the present invention is shown generally at 24 attached to the lower threaded end of pipe string 18 and positioned within casing 14 to define an annulus 26 between casing 14 and washing tool 24. Washing tool 24 includes a mandrel generally indicated at 28 positioned between an upper sub 30 and a lower sub 32. Upper sub 30 has opposed internally threaded end portion 34. Upper end portion 34 is in threaded connection with the lower end of pipe string 20 and lower end portion 34 is in threaded connection with mandrel 28. Lower sub 32 has internally threaded opposed end portions 36. Lower end portion 36 receives a lower end piece 38 having a central bore and open lower end. A disc valve 40 is pivotally mounted for movement between open and closed positions relative to the central bore of end piece 38 about a pivot pin 42 secured to the upper end of end piece 38.

Mandrel 28 has an axial bore 44 extending therethrough and a bypass tube generally indicated at 46 is mounted within bore 44 and extends between upper and lower subs 30,32. Bypass tube 46 has an axial or longitudinal flow passage 48 therein and an upper port 50 in upper sub 30 extends through sub 30 and provides fluid communication between annulus 26 and flow passage 48. A lower port 52 in lower sub 32 provides fluid communication between annulus 26 and bypass fluid passage 48. Ports 50 and 52 are preferably around $\frac{5}{8}$ inch in diameter. Thus, fluid in annulus 26 may bypass mandrel 28 through the flow passage 48 formed by bypass tube 46.

Mandrel 28 includes an upper end section 54, a lower end section 56, and an intermediate section or portion 58 extending between end sections or portions 54 and 56. Upper and lower end portions 54, 56 are generally identical and only end portion 54 will be explained in detail as it is to be understood that lower end portion 56 is substantially identical to upper end portion 54 and like reference numerals are employed for similar elements. Upper end portion 54 has opposed small diameter externally threaded ends 60 and adjacent enlarged intermediate externally threaded portions 62 as shown particularly in FIG. 3. An elastomeric tubular packer or packing element 64 between threaded portions 62 extends about and is in face to face contact with the adjacent outer peripheral surface of upper end portion 54 in the unset position of tool 24. A plurality of parallel inwardly projecting annular beads 66 are provided on opposed marginal end portions 68 of upper packer 64. Annular grooves 70 about the outer peripheral surface of upper end portion 54 receive beads 66 therein. Upper and lower caps or sleeves 72 having inner tapered surfaces 71 are threaded onto enlarged diameter threaded portions 62 about marginal end portions 68 of packer 64 and have annular internal shoulders 74 in abutting relation to the adjacent ends of packer 64. During threading onto threaded end portions 62, the internal tapered surfaces 71 of caps 72 urge end portions 68 and beads 66 into tight sealing relation with end section 54 for securing packer 64 in face to face contact with end section 54. Ports 73 through the wall of end portion 54 adjacent lower marginal end portion 68 provides fluid passages in continuous communication with mandrel bore 44 to permit fluid flow to chamber 75 formed between end portion 54 and packer 64 for inflating packer 64. Four ports 73 are preferably provided for packer 64 and are a diameter preferably around $\frac{3}{8}$ inch in diameter. A minimum diameter of at least around $\frac{1}{8}$ inch in diameter, or a slot having a width of at least $\frac{1}{8}$ inch, would be desirable in order to provide sufficient clearance for foreign matter, such as sand, to be discharged from chamber 75 upon deflation of packer 64. The elastomeric material from which packer 64 is formed may be bonded, if desired, by a suitable chemical bonding material applied to marginal end portions 68 and heated to a predetermined temperature for bonding to the outer surface of end portion 54. Packer 64 is of a relatively short length, such as ten (10) to fifteen (15) inches, so that inflation and deflation of packer 64 occurs in a minimum of time.

Intermediate section 58 of mandrel 28 has threaded female end portions receiving threaded ends 60 of the adjacent upper and lower end portions 54, 56 of mandrel 28. The outer surface of intermediate section 58 has a plurality of external vertical grooves 76 therein which receive metallic spring strips 78 anchored at 80 to intermediate section 58. Spring strips 78 are bowed outwardly for engaging the adjacent inner surface of casing 14 to maintain wash tool 24 in a centered position with respect to casing 14.

Extending through the wall of intermediate section 58 are sleeves 82 defining ports 84. Resilient leaf springs 86 fit within recesses 88 in intermediate section 58 and are anchored by suitable screws 90. An elastomeric sealing strip 92 is secured to the inner face of each leaf spring 86 and fits over associated port 84 as shown particularly in FIGS. 3–5. Recesses 88 have tapered sides and upon opening of ports 84, leaf springs 86 act as deflectors and fluid is dispersed outwardly by springs 86 along the tapered sides of recesses 88. Ports 84 are preferably around 5/16 inch in diameter.

Fluid pressure from pipe string 18 and mandrel bore 44 is communicated through ports 73 for inflating packers 64 radially outwardly while marginal end portions 68 are held in a fixed position. Since packers 64 are elastomeric, the packers may extend laterally a substantial distance and are operable with casing having various diameters. Additionally, since ports 73 are located adjacent the lower ends of packers 64, upon a discharge or emptying of fluid from fluid chambers 75 as shown in FIG. 2, any foreign matter or debris will be easily discharged from chambers 75 through ports 73 into the mandrel bore 44. Packers 64 are designed to be inflated at a fluid pressure of around one hundred (100) psi for effecting a sealing relation with casing 14. Leaf springs 86 are designed to open ports 84 at a fluid pressure of preferably around two hundred (200) psi, and not higher than around five hundred (500) psi in any event.

In operation, tool 24 is attached to the lower end of pipe string 18 and lowered into the perforated casing 14 to the desired depth with disc valve 40 being in an open position as shown in FIG. 1 by contact with the fluid in the bore hole. After washing tool 24 reaches the desired depth, pump 22 is activated for pumping hydraulic fluid through pipe string 18 and fluid pressure through mandrel bore 44 moves disc valve 40 to a closed position. Upon the fluid pressure in mandrel bore 44 reaching a predetermined amount, such as one hundred (100) psi, packers 64 are urged outwardly into sealing engagement with the inner surface of perforated casing 14 from fluid pressure exerted through ports 73. During the movement of packers 64 outwardly into sealing engagement with casing 14, ports 84 are closed by leaf springs 86. Upon the reaching of the second higher predetermined pressure in mandrel bore 44, such as two hundred (200) psi, leaf springs 86 are urged outwardly to open ports 84 and fluid from mandrel bore 44 flows through perforations 16 into the surrounding formation washing any loose sand or permeating the formation to improve the flow characteristics of the well. The circulating fluids and materials carried therein reenter casing 14 through the perforations above upper packer 64 for flow through annulus 26 to the surface of the well for disposal. Fluids and materials below lower packer 64 may bypass packers 64 through bypass tube 46 for entering annulus 26 above upper packer 64.

After it is determined that adequate circulation has occurred, fluid pressure is relieved from pipe string 18 and leaf springs 86 return to a position closing and blocking ports 84. A further reduction of pressure then causes radial contraction of elastomeric packers 64 to squeeze the fluid from chambers 75 outwardly through ports 73 into mandrel bore 44 without any axial compression or contraction of packers 64.

If desired, flow can then be reversed down the annulus 26 of casing 14 through perforations 16 into the washed out area adjacent the tool and beneath lower sub 32. Further circulation will effect opening of flapper valve member 40 with the fluid being circulated from the well bore bottom through mandrel flow passage 44 to be removed by pipe string 18 at the surface.

If desired to space packers 64 a substantial distance from each other, an additional pipe section of a predetermined length may be positioned between intermediate section 58 and end section 54 or end section 56. This may be desirable when acidized materials are injected within the zone between packers 64, for example.

Referring to FIG. 6, a sub is shown at 94 connected at its upper end to pipe string 18A and connected at its lower end to upper sub 30A. Sub 94 is adapted to be used after completion of the wash operation and prior to the movement of the wash tool. An inner sleeve 96 is mounted within the bore of sub 94 by shear pins 98 and cover ports 100. O-rings 102 seal between the ends of sleeve 96 and sub 94. In operation after the completion of the wash operation, a ball 104 is dropped down the bore 20A of pipe string 18A and seats on the upper end of sleeve 96 to block fluid flow through bore 20A. Upon an increase in fluid pressure in the bore 20A above a predetermined amount, shear pins 98 are sheared and sleeve 96 moves downwardly to open ports 100 thereby to permit fluid flow through ports 100 from bore 20A. Thus, the packers of the wash tool are not inflated by fluid pressure through bore 20A upon the removal of the tool from the well bore.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A tool for washing a perforation zone in an earth formation adjacent a perforated casing in a bore hole of a well comprising:

a tubular mandrel having an axial flow passage therethrough and adapted to be connected at its upper end to a drill string for receiving pressurized fluid therefrom, said tubular mandrel including an end section adjacent opposite ends thereof to define upper and lower end sections each having opposed threaded upper and lower ends, and a one piece intermediate section of a relatively short length connected directly to said end sections and having opposed threaded ends engaging adjacent ends of said end sections;

an elastomeric tubular packer on each mandrel end section in face to face contact with the outer peripheral surface of said mandrel and defining upper and lower packers;

means on said mandrel securing the upper and lower ends on each of said elastomeric packers in fixed position on the mandrel;

first fluid passage means through the mandrel wall from the axial flow passage to each of said packers to provide fluid from the mandrel bore to the area between the outer peripheral surface of the mandrel and the inner surface of the packers for urging the packers outwardly into sealing engagement with the adjacent inner surface of the casing upon the reaching of a first predetermined fluid pressure in the mandrel bore;

second fluid passage means in said intermediate section extending through the mandrel wall form the axial flow passage at location between the packers of supplying fluid to the perforation zone adjacent the casing; and fluid control means blocking fluid flow through said second fluid passage means at said first predetermined fluid pressure, said fluid control means being actuated at a second higher predetermined fluid pressure in said mandrel bore to permit fluid flow through said second fluid passage means and the perforated casing to said perforation zone outside the casing.

2. A tool as set forth in claim 1 wherein said fluid control means comprises a resilient leaf spring covering said second fluid passage means for blocking fluid flow therethrough at said first predetermined fluid pressure and uncovering said second fluid passage means at said second higher predetermined fluid pressure to permit fluid flow to said perforation zone through the perforated casing.

3. A tool as set forth in claim 1 wherein said first fluid passage means is positioned adjacent the lower end of each said elastomeric packers and upon a reduction of fluid pressure below said first predetermined fluid pressure, said fluid in the area between the outer surface of the mandrel and the inner surface of the elastomeric packers is discharged through said first fluid passage means into the mandrel bore.

4. A tool as set forth in claim 1 wherein said fluid control means includes a resilient valve member continuously biased toward a position covering said second fluid passage means and blocking fluid flow therethrough, and urged away from said second fluid passage means at said second higher predetermined fluid pressure to permit fluid flow therethrough from said mandrel bore, said resilient valve member returning to a position covering said second fluid passage means upon a reduction in fluid pressure below said second higher predetermined fluid pressure.

5. A tool as set forth in claim 1 wherein a bypass tube is positioned within said mandrel bore and has end portions extending beyond said upper and lower packers, said bypass tube having an axial flow passage and a port at opposite ends beyond the adjacent packers extending through said mandrel wall whereby fluid in the bore hole may bypass said packers through said bypass tube for equalizing fluid pressure on opposed ends of said packers

6. A tool as set forth in claim 1 wherein a disc valve member is mounted for pivotal movement within said mandrel between open and closed positions relative to said mandrel bore, said valve member being positioned within said mandrel bore at a position below said lower packer and movable to a closed position upon the exertion of fluid pressure from the drill string.

7. A tool for washing a perforation zone in an earth formation adjacent a perforated casing in the bore hole of a well comprising:

a tubular mandrel having a bore defining an axial flow passage therethrough and adapted to be connected at its upper end to a drill string for receiving pressurized fluid therefrom, said tubular mandrel including an end section adjacent opposite ends thereof to define upper and lower end sections, each end section having opposed threaded upper and lower ends, and an intermediate section between said end portions having threaded ends engaging adjacent threaded ends of said end sections;

an elastomeric tubular packer on each of said end sections in face to face contact with the outer peripheral surface of the associated end section and defining spaced upper and lower packers for forming a perforation zone therebetween;

means on said mandrel securing the upper and lower ends of each of said elastomeric packers in fixed position on its associated end section;

a lateral port through the mandrel wall of each of said end sections adjacent the lower end of each of the packers to provide fluid flow from the mandrel bore to an area between the outer peripheral surface of the associated end sections and the inner surface of the packers for urging the packers outwardly into sealing engagement with the adjacent inner surface of the casing upon the exertion of a predetermined fluid pressure from the mandrel bore;

an additional fluid passage through the mandrel wall of said intermediate section for providing fluid to the perforation zone;

fluid control means for said additional fluid passage to control the flow of fluid through said additional fluid passage to said perforation zone;

a valve member mounted for movement between open and closed portions within said mandrel bore at a position below the packers, said valve member being movable to a closed position upon exertion of fluid pressure from the drill string; and a bypass tube positioned within said mandrel bore above said valve member and extending beyond said packers, said bypass tube having an axial flow passage and a lateral port at each end thereof extending through the mandrel wall at a position beyond the adjacent packer and perforation zone for permitting fluid in the annulus between the tool and perforated casing to bypass the perforation zone.

8. A tool as set forth in claim 7 wherein said flow control means block fluid flow through said additional flow passage at the predetermined fluid pressure for moving the packers into sealing engagement with the casing, said flow control means permitting fluid flow through said additional flow passage upon the reaching of a second higher predetermined fluid pressure in said mandrel bore.

9. A tool as set forth in claim 8 wherein said flow control means comprises a resilient leaf spring covering said additional flow passage and being urged out of blocking relation with said additional flow passage upon the reaching of a second higher predetermined fluid pressure in the mandrel bore, said leaf spring returning to said blocking position upon a decrease in fluid pressure in said mandrel bore below said second predetermined fluid pressure.

10. A tool as set forth in claim 7 wherein said flow passage for each of said end sections is positioned adjacent the lower end of each of said elastomeric packers.

11. A tool as set forth in claim 7 wherein each of said end sections has a sleeve threaded thereon adjacent each end of the associated packer for tightly gripping an adjacent marginal end portion of the packer onto the mandrel in fixed relation.

12. A tool as set forth in claim 11 wherein each of the packers has a plurality of spaced parallel extending annular internal beads arranged on said marginal end portions, and the adjacent peripheral surface of the mandrel has a plurality of annular grooves receiving said beads therein for securing the packers onto the mandrel.

13. A tool for washing a perforation zone in an earth formation adjacent a perforated casing in the bore hole of a well comprising:

a tubular mandrel having a bore defining an axial flow passage therethrough and adapted to be connected at its upper end to a drill string for receiving pressurized fluid therefrom, said tubular mandrel including an end section adjacent opposite ends thereof to define upper and lower end sections, and an intermediate section between said end sections;

an elastomeric tubular packer on each of said end sections in face to face contact with the outer peripheral surface of the associated end section and defining spaced upper and lower packers for forming a perforation zone therebetween;

means securing the upper and lower ends of each of said elastomeric packers in fixed position on its associated mandrel end section;

a fluid passage through the mandrel wall of each of said end sections to provide fluid flow from the mandrel bore to an area between the outer peripheral surface of the associated end sections and the inner surface of the packer for urging the packers outwardly into sealing engagement with the adjacent inner surface of the casing upon the exertion of a predetermined fluid pressure from the mandrel bore;

an additional fluid passage through the mandrel wall of said intermediate section for providing fluid to the perforation zone;

a first valve member within said mandrel bore at a position below the packers and mounted for movement between open and closed positions relative to said bore, said valve member being movable to a closed position upon exertion of fluid pressure in the bore;

a bypass tube within said mandrel bore above said valve member adjacent said packers and having a lateral port at each end thereof extending through the mandrel wall at a position beyond the adjacent packer for providing fluid communication in the well bore between opposed ends of said packers for a fluid bypass of said packers and the perforation zone;

a sleeve within the mandrel bore positioned over lateral ports in said mandrel and having a central valve seat thereon;

a ball valve member adopted to be seated within the mandrel bore on said sleeve seat above said bypass tube for blocking the mandrel bore to fluid flow after the washing operation; and shear pins holding said sleeve in position over said lateral ports whereby upon insertion of said ball valve member within said mandrel bore on said seat said shear pins are sheared upon reaching of a predetermined high fluid pressure in said mandrel bore above said ball valve member and said sleeve moves downwardly to permit lateral flow from said bore through said ports into the annulus.

14. A method of circulating fluid in a well having a perforated casing at a predetermined depth in the perforation zone comprising the steps of:

attaching a washing tool including a mandrel to the lower end of a pipe string, the mandrel including a pair of spaced elastomeric tubular packers secured to said mandrel at their upper and lower ends and in face to face contact with the outer peripheral surface of the mandrel with fluid flow passages for inflating the packers extending through the mandrel wall to the packer elements, the mandrel including fluid control means covering ports through the mandrel wall at a position between said packer elements for controlling the flow of fluid to the perforation zone;

lowering said washing tool on said pipe string to the desired circulation level within said perforated casing with a disc valve on the lower end of the washing tool being in an open position resulting from the fluid in the mandrel bore exerting an upward pressure during downward movement of the mandrel within the well to permit fluid in the well;

pumping fluid through said pipe string and moving said disc valve to a closed position for increasing the fluid pressure within the mandrel bore and providing fluid to the area between the outer surface of the mandrel and the inner surface of the packers for inflating the packers upon outward radial movement thereof into sealing engagement with the inner peripheral surface of said perforated casing upon the reaching of a predetermined relatively low fluid pressure;

increasing the fluid pressure within said pipe string to a higher predetermined level for effecting actuation of said valve means and uncovering of said ports independently of said packers to permit the circulation of fluid from said pipe string through the perforated casing between said packers;

providing a bypass tube within said mandrel bore to bypass said packers and said perforation zone with opposed ends of said bypass tube in fluid communication with the annulus between the tool and perforated casing;

providing means above the bypass tube to block flow of fluid downwardly through the mandrel bore and to permit flow of fluid laterally outwardly of the tool above the upper packer; and withdrawing the washing tool from the well after completion of the wash operation and blocking the downward flow of fluid through the mandrel bore.

* * * * *